US011794206B2

(12) United States Patent
Assis, Jr.

(10) Patent No.: US 11,794,206 B2
(45) Date of Patent: Oct. 24, 2023

(54) APPLICATOR FOR APPLYING MATERIAL NEAR THE EDGES OF A VEHICLE DOOR

(71) Applicant: Epaminondas V. Assis, Jr., Yardley, PA (US)

(72) Inventor: Epaminondas V. Assis, Jr., Yardley, PA (US)

( * ) Notice: Subject to any disclaimer, the term of this patent is extended or adjusted under 35 U.S.C. 154(b) by 41 days.

(21) Appl. No.: 17/381,190

(22) Filed: Jul. 21, 2021

(65) Prior Publication Data

US 2023/0021810 A1 Jan. 26, 2023

(51) Int. Cl.

| | |
|---|---|
| ***B05C 17/005*** | (2006.01) |
| ***B05D 1/26*** | (2006.01) |
| *B05B 1/10* | (2006.01) |
| *B05D 7/14* | (2006.01) |

(52) U.S. Cl.

CPC .... *B05C 17/00503* (2013.01); *B05C 17/0052* (2013.01); *B05C 17/00516* (2013.01); *B05D 1/26* (2013.01); *B05B 1/10* (2013.01); *B05C 17/00593* (2013.01); *B05D 7/14* (2013.01)

(58) Field of Classification Search

CPC ..... B05C 17/0052; B05C 17/00589; B05C 17/00503; B05C 17/00516; B05C 17/00593

USPC ..... 401/193

See application file for complete search history.

(56) References Cited

U.S. PATENT DOCUMENTS 807,887 A * 12/1905 Walker ..... B43M 11/00 15/210.1
2,143,661 A 1/1939 Schrader
3,411,178 A * 11/1968 Szentivanszky ..... B05C 17/00596 425/461
3,653,560 A 4/1972 Adams et al.
4,260,273 A 4/1981 Hemperly, Jr. et al.
4,957,225 A 9/1990 Childers
5,000,361 A 3/1991 Briddell et al.
5,017,113 A 5/1991 Heaton et al.
5,044,803 A * 9/1991 Kurosawa ..... B05C 17/00516 401/265
6,390,709 B1 * 5/2002 Zerebecki ..... B43M 11/08 401/265
2005/0051571 A1 * 3/2005 Carruth ..... B05C 17/00596 222/326

(Continued)

FOREIGN PATENT DOCUMENTS

DE 3621123 A1 * 1/1988 ..... B05C 17/00596

*Primary Examiner* — Patrick M. Buechner

(74) *Attorney, Agent, or Firm* — LaMorte & Associates, P.C.

(57) ABSTRACT

A dispensing head for a supply tube that enables material to be evenly applied adjacent to the peripheral edge of a thin structure, such as a vehicle door. The dispensing head has a first end with a first opening and a second end with a discharge opening. A guide extends from the second end. The guide includes a descending element and a lateral foot element, wherein the bottom surface of the second end, the descending element, and the lateral foot element define three sides of an open gap space. The dispensing head is attached to a supply tube. The thin structure is positioned within the guide. The hook shaped guide positions the discharge opening a set distance from the application surface on the thin structure. The guide is moved along the peripheral edge where the material can be dispensed evenly at a set distance from the peripheral edge.

15 Claims, 6 Drawing Sheets

(56) References Cited

U.S. PATENT DOCUMENTS

| | | | | |
|---|---|---|---|---|
| 2005/0133547 | A1 | 6/2005 | Swann | |
| 2007/0017938 | A1 | 1/2007 | Thompson et al. | |
| 2014/0331921 | A1* | 11/2014 | Gausepohl | C09J 5/00 118/300 |
| 2015/0191041 | A1* | 7/2015 | Slevin | B05C 17/0052 401/48 |
| 2016/0325304 | A1* | 11/2016 | Pham | B05C 17/00516 |

* cited by examiner

APPLICATOR FOR APPLYING MATERIAL NEAR THE EDGES OF A VEHICLE DOOR

BACKGROUND OF THE INVENTION

1. Field of the Invention

In general, the present invention relates to applicators that are used to apply material from a supply tube to a surface. More particularly, the present invention relates to applicators that attach to supply tubes in caulking tube guns to control both the shape and volume of material being dispensed.

2. Prior Art Description

Many materials, such as adhesives, caulk, silicone, sealants, roofing tar, and the like are sold packaged in disposable supply tubes. The disposable supply tubes typically have an elongated dispensing nozzle at one end. The supply tube of material is placed within an applicator gun, which is commonly called a caulking gun. The applicator gun advances a plunger into the supply tube as the applicator gun is operated. The advancing plunger displaces the contents of the supply tube out through the elongated dispensing nozzle.

The elongated dispensing nozzle typically has a round profile. As a result, the material dispensed from the tube is typically dispensed as a cylindrical bead. In the prior art, there have been auxiliary dispensing heads that can be placed over the elongated dispensing nozzle of a supply tube. The purpose of the auxiliary head is usually to change the shape of the dispensing material away from the typical cylindrical bead. For instance, U.S. Pat. No. 3,653,560 to Adams, and U.S. Pat. No. 5,000,361 to Briddell, both show auxiliary dispensing heads that convert the shape of the material exiting a supply tube into a flat ribbon.

When an applicator gun and a supply tube are used to administer material to a surface, the distance between the supply tube and the surface must be kept consistent. If the distance between the supply tube and the applicator is kept consistent and the discharge rate of the applicator gun is kept consistent, then the material can be applied in a consistent manner. In the prior art, specialized heads have been developed that contain wheels. The wheels roll along a surface, therein keeping the dispensing nozzle at a constant distance from the surface during the application. Such prior art is exemplified by U.S. Pat. No. 4,260,273 to Hemperly.

A problem associated with the use of wheels is that the wheels must roll along a flat smooth surface in order to dispense the material from the supply tube evenly. In industry, this is highly problematic because surfaces are rarely smooth and are seldom flat. Rather, in industry, material from supply tubes often must be applied over highly contoured surfaces that contain seams, welds, and other surface anomalies. For example, material from a supply tube is commonly applied to the interior surface of a vehicle door in order to attach weatherstripping to the door. The weatherstripping is typically applied adjacent to the periphery of the door. Doors for most vehicles have complex shapes. The door is curved and contoured in multiple planes. Furthermore, the interior of the door contains metal seams, weld depressions, recesses, and many other structural features that would prevent any applicator wheel from smoothly rolling along the surface.

A need therefore exists for an auxiliary head that can be attached to a supply tube in an applicator gun that would assist a person in applying a consistent ribbon of material along a highly contoured surface. This need is met by the present invention as described and claimed below.

SUMMARY OF THE INVENTION

The present invention is a dispensing head for a supply tube that enables material to be evenly applied adjacent to the peripheral edge of a thin structure, such as a vehicle door. The dispensing head has a first end with a first opening and a second end with a discharge opening. An internal conduit extends between the first opening and the discharge opening.

A guide extends from the second end. The guide includes a descending element and a lateral foot element, wherein the bottom surface of the second end, the descending element, and the lateral foot element define three sides of an open gap space.

To apply material to a surface, such as a vehicle door, a supply tube of material is provided. The supply tube has a dispensing nozzle. A dispensing head is attached over the dispensing nozzle, wherein the dispensing head has a hook shaped guide that extends from the distal end. The supply tube and the dispensing head are loaded into an applicator gun that selectively displaces the material out of the supply tube through the discharge opening of the dispensing head.

The peripheral edge of the thin structure is positioned within the hook shaped guide. The hook shaped guide positions the discharge opening a set distance from the application surface on the thin structure. The hook shaped guide is moved along the peripheral edge while operating the applicator gun. As a result, the material can be dispensed evenly at a set distance from the peripheral edge.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention composition can be embodied in many ways, only two exemplary embodiments are illustrated. The exemplary embodiments are being shown for the purposes of explanation and description. The exemplary embodiments are selected in order to set forth some of the best modes contemplated for the invention. The illustrated embodiments, however, are merely exemplary and should not be considered limitations when interpreting the scope of the claims.

Figure 1:
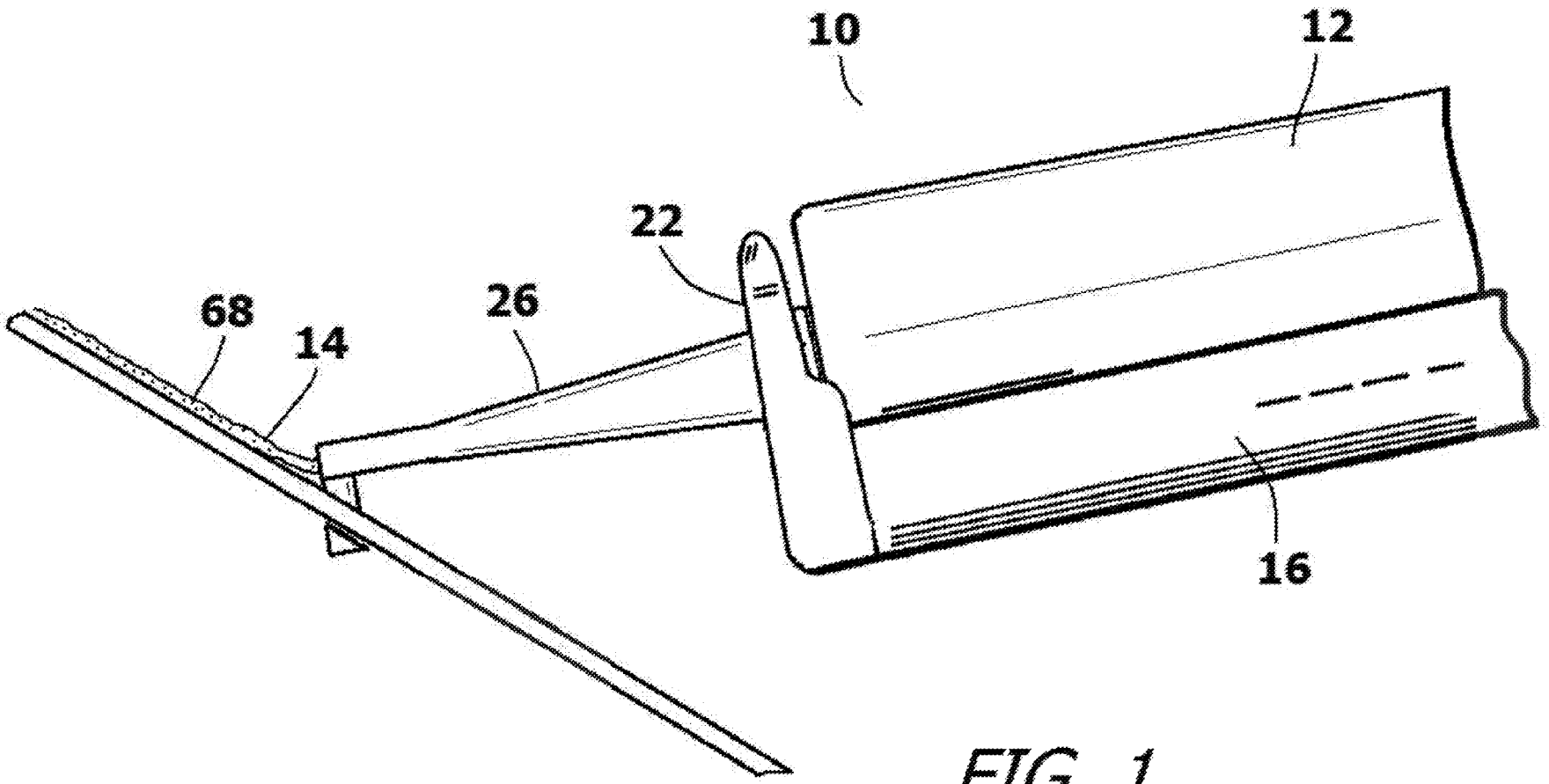
FIG. 1 shows an exemplary embodiment of an application system having an applicator gun, a supply tube and an auxiliary dispensing head.
Figure 2:
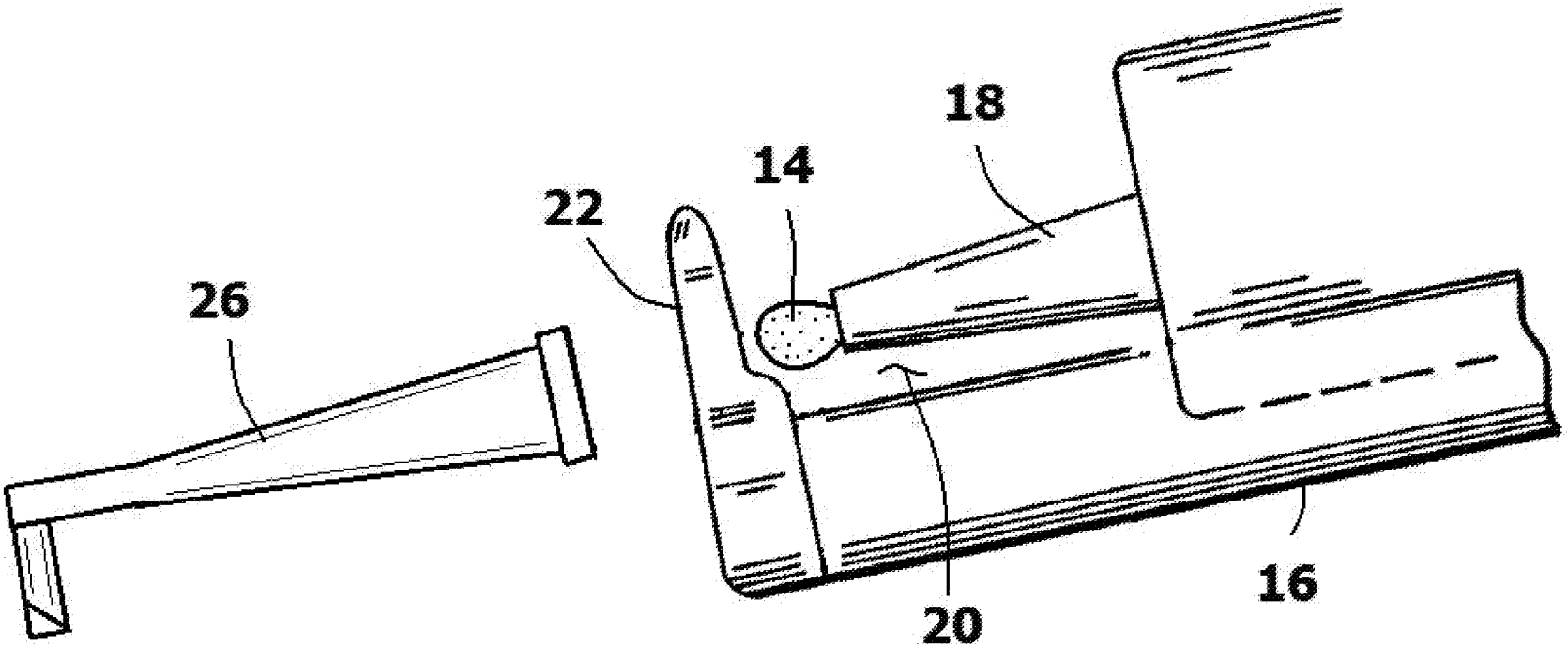
FIG. 2 is an exploded view of the exemplary embodiment of FIG. 1.

Referring to FIG. 1 and FIG. 2, an application system 10 is shown. The application system 10 includes a supply tube 12 of material 14 and an applicator gun 16. The supply tube 12 has a narrow nozzle 18 at one end. The applicator gun 16 defines a tubular receptacle 20 for receiving the supply tube 12. The supply tube 12 is placed in the tubular receptacle 20. The tubular receptacle 20 has a slotted wall 22 against which the supply tube 12 is pressed. The slotted wall 22 defines a slot that enables the narrow nozzle 18 of the supply tube 12 to extend beyond the slotted wall 22 in the traditional manner. The applicator gun 16, when activated, displaces the material 14 out of the supply tube 12 through the narrow nozzle 18. It will be understood that there are many applicator guns in the marketplace and that the shown embodiment is meant to be exemplary of any and all applicator guns that can displace material from supply tubes. The applicator gun 16 shown is a manually operated applicator gun. Other applicator guns include electric applicator guns and pneumatic applicator guns. Likewise, it will be understood that the material 14 contained in the supply tube 12 can be an adhesive, a sealant, or any other compound that is traditionally packaged in supply tubes.

Figure 3:
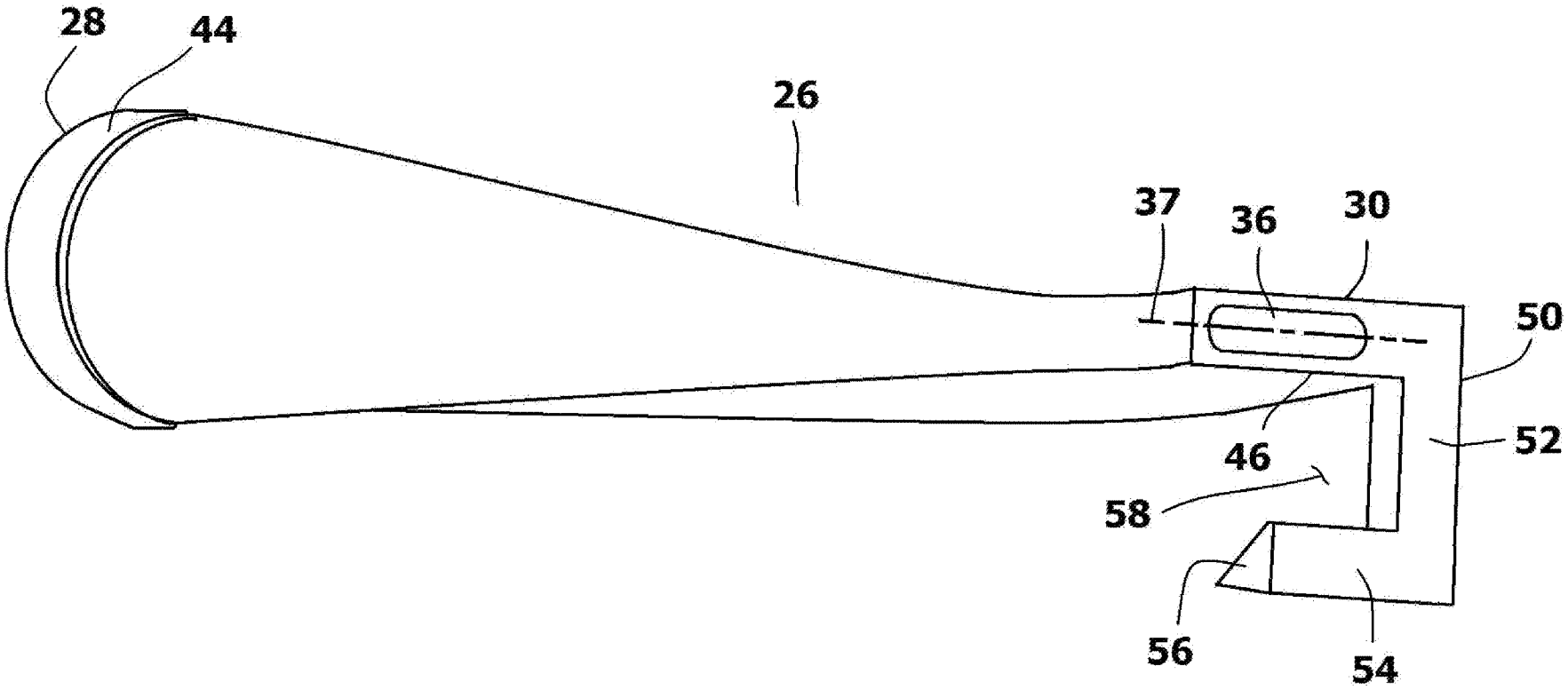
FIG. 3 is an enlarged view of an exemplary embodiment of the auxiliary dispensing head.
Figure 4:
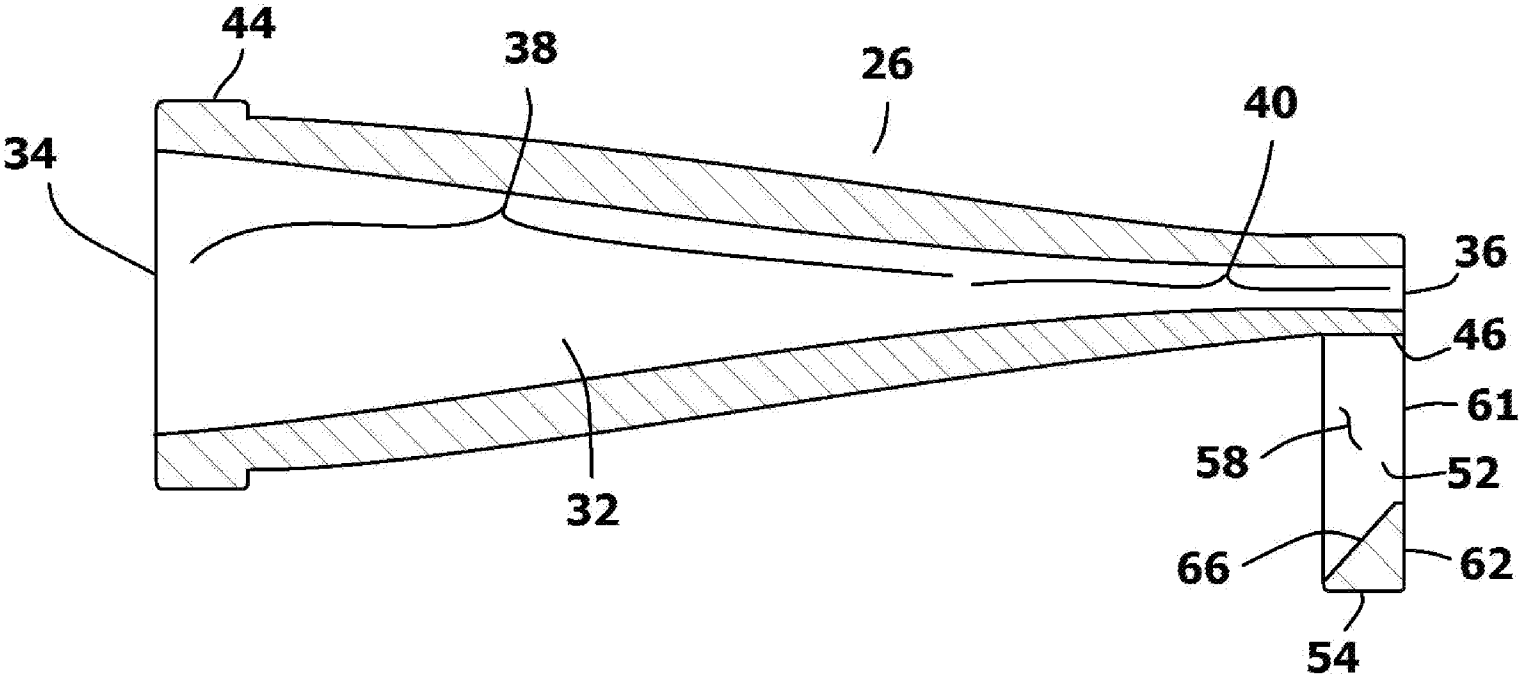
FIG. 4 is a cross-sectional view of the embodiment of FIG. 3.

An auxiliary dispensing head 26 is provided. The auxiliary dispensing head 26 passes over the narrow nozzle 18 of the supply tube 12. As such, any material 14 that is displaced from the supply tube 12 must first flow through the auxiliary dispensing head 26 before it reaches the application surface. Referring to FIG. 3 and FIG. 4, in conjunction with FIG. 1 and FIG. 2, it can be seen that the auxiliary dispensing head 26 has a first end 28 and an opposite second end 30. A first opening 34 is formed in the first end 28 of the auxiliary dispensing head 26. Conversely, a distal second opening 36 is formed in the second end 30 of the auxiliary dispensing head 26. A conduit 32 extends through the auxiliary dispensing head 26 between the first opening 34 and the second opening 36. The conduit 32 has a first section 38 that leads into the auxiliary dispensing head 26 from the first opening 34. The first section 38 is shaped to receive the narrow nozzle 18 of the supply tube 12. As such, the first section 38 has a circular cross-section that tapers to receive the circular shape of the narrow nozzle 18.

The conduit 32 also has a second section 40 that leads from the first section 38 to the second opening 36. The second opening 36 is not round. Rather, the second opening 36 is a discharge opening that is shaped as an elongated slot. As such, the second opening 36 has a long axis 37. In this manner, when the material 14 flows through the second opening 36, the material 14 is discharged as a thin ribbon, rather than a round bead. The second section 40 of the conduit 32 has a complex shape that begins round and transitions to the slot shape of the second opening 36.

The auxiliary dispensing head 26 is placed over the narrow nozzle 18 of the supply tube 12 before the supply tube 12 is received by the applicator gun 16. The exterior 42 of the auxiliary dispensing head 26 has a complex shape. The auxiliary dispensing head 26 generally tapers from the first end 28 toward the second end 30. A flange 44 is provided on the exterior of the auxiliary dispensing head 26 proximate the first end 28. The flange 44 is wider than the slot 24 in the slotted wall 22. Accordingly, when the auxiliary dispensing head 26 is placed over the narrow nozzle 18 and the supply tube 12 is placed in the applicator gun 16, the flange 44 of the auxiliary dispensing head 26 becomes trapped between the supply tube 12 and the slotted wall 22. This locks the auxiliary dispensing head 26 in place and prevents the auxiliary dispensing head 26 from inadvertently detaching from the supply tube 12.

The second end 30 of the auxiliary dispensing head 26 has a flat bottom edge 46 that is parallel to the long axis 37 of the second opening 36. A guide 50 extends from the second end 30 of the auxiliary dispensing head 26. The guide 50 has a descending element 52 that extends at a perpendicular from the bottom edge 46 of the second end 30. The descending element 52 terminates with a lateral foot element 54. The lateral foot element 54 extends from the descending element 52 to a free end 56. The lateral foot element 54 is under the second opening 36 in the auxiliary dispensing head 26 and is parallel with the bottom edge 46 of the second end 30. This provides the guide 50 with a hooked shape that can appear as a horizontally flipped L-shape or general J-shape. Accordingly, there is a gap space 58 defined on three sides by the lateral foot element 54, the descending element 52, and the bottom edge 46 of the second end 30.

The descending element 52 and the lateral foot element 54 both have respective flat surfaces 61, 62 that are coplanar with the second end 30 of the auxiliary dispensing head 26. The descending element 52 also has a perpendicular flat surface 64 that faces the gap space 58. The lateral foot element 54 has a beveled surface 66 that faces the gap space 58 of the guide 50. The beveled surface 66 makes the lateral foot element 54 narrowest at the gap space 58, wherein the lateral foot element 54 increases in thickness as the distance from the gap space 58 increases.

Figure 5:
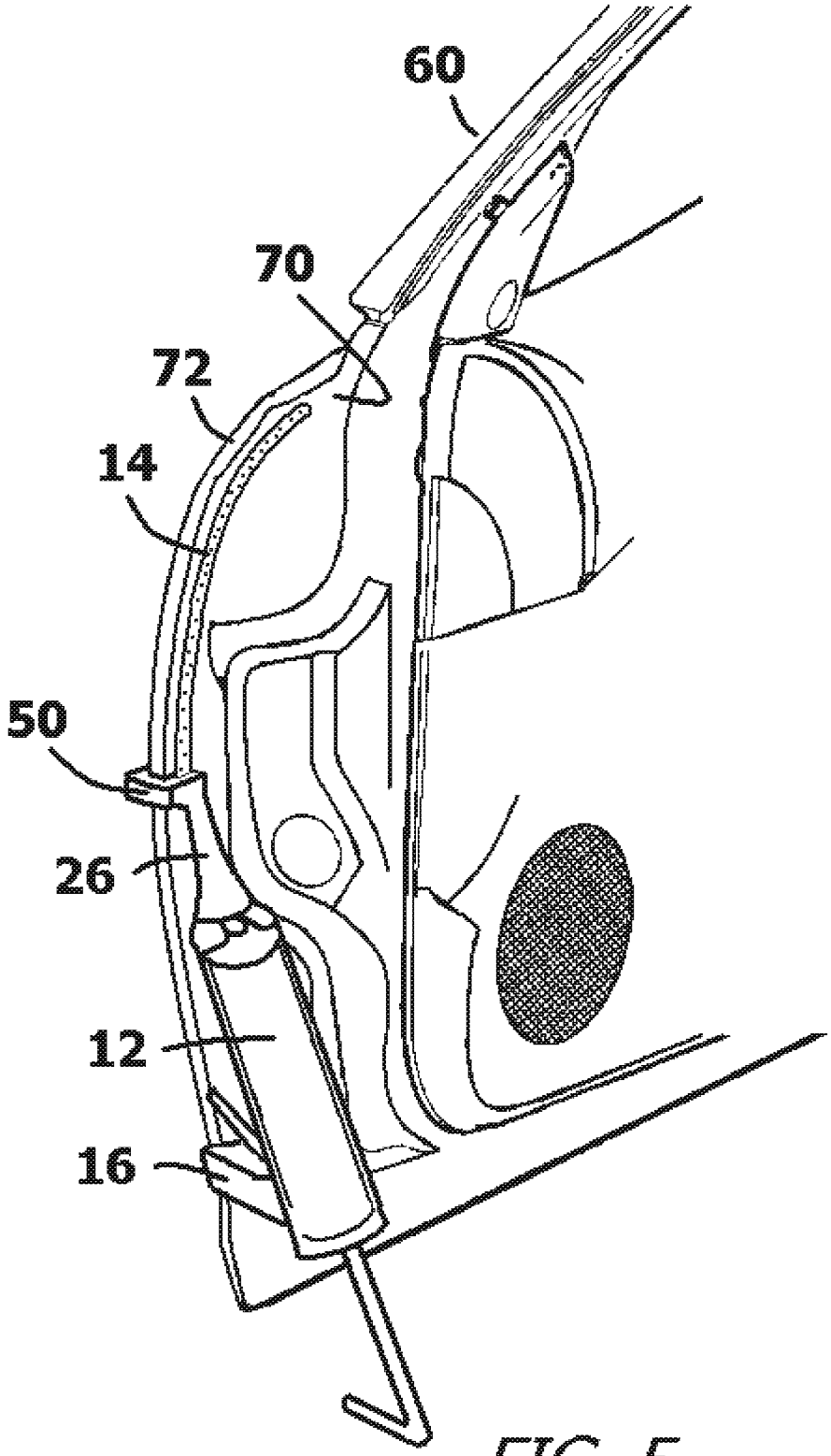
FIG. 5 shows the application system being used to dispense material onto a vehicle door.

Referring to FIG. 5 in conjunction with FIG. 1 and FIG. 3, the application system 10 is shown applying a ribbon 68 of material 14 along the interior surface 70 of a vehicle door 60 in a position adjacent the peripheral edge 72 of the door 60. The vehicle door 60 is contoured. Furthermore, the interior surface 70 contains seams, weld depressions, and other disruptions 74. To use the application system 10, the auxiliary dispensing head 26 is attached to a supply tube 12. The supply tube 12 is then inserted into an applicator gun 16. In this configuration, the auxiliary dispensing head 26 extends over the narrow nozzle 18 of the supply tube 12. Any material 14 displaced from the supply tube 12 will be directed through the second opening 36 at the second end 30 of the auxiliary dispensing head 26. Since the second opening 36 is shaped as an elongated slot, the material 14 exiting the second opening 36 will be dispensed as a ribbon 68.

The guide 50 that extends from the auxiliary dispensing head 26 is hooked around the peripheral edge 72 of the vehicle door 60. This positions the vehicle door 60 in the gap space 58 of the guide 50. The guide 50 is then angled by inclining the auxiliary dispensing head 26 on the supply tube 12. The guide 50 is inclined until both the bottom edge 46 of the second end 30 and the beveled surface 66 of the lateral foot element 54 contact opposite surfaces of the vehicle door 60. By maintaining the dual contact points, the second opening 36 can be kept a constant distance from the interior surface 70 of the vehicle door 60. Likewise, by contacting the descending element 52 with the peripheral edge 72 of the vehicle door 60, the second opening 36 can be maintained a constant distance from the peripheral edge 72. The result is that the material 14 can be applied in a smooth consistent ribbon 68 that is a constant distance from the peripheral edge 72. This is optimal for the installation of weatherstripping along the inside periphery of the vehicle door.

Figure 6:
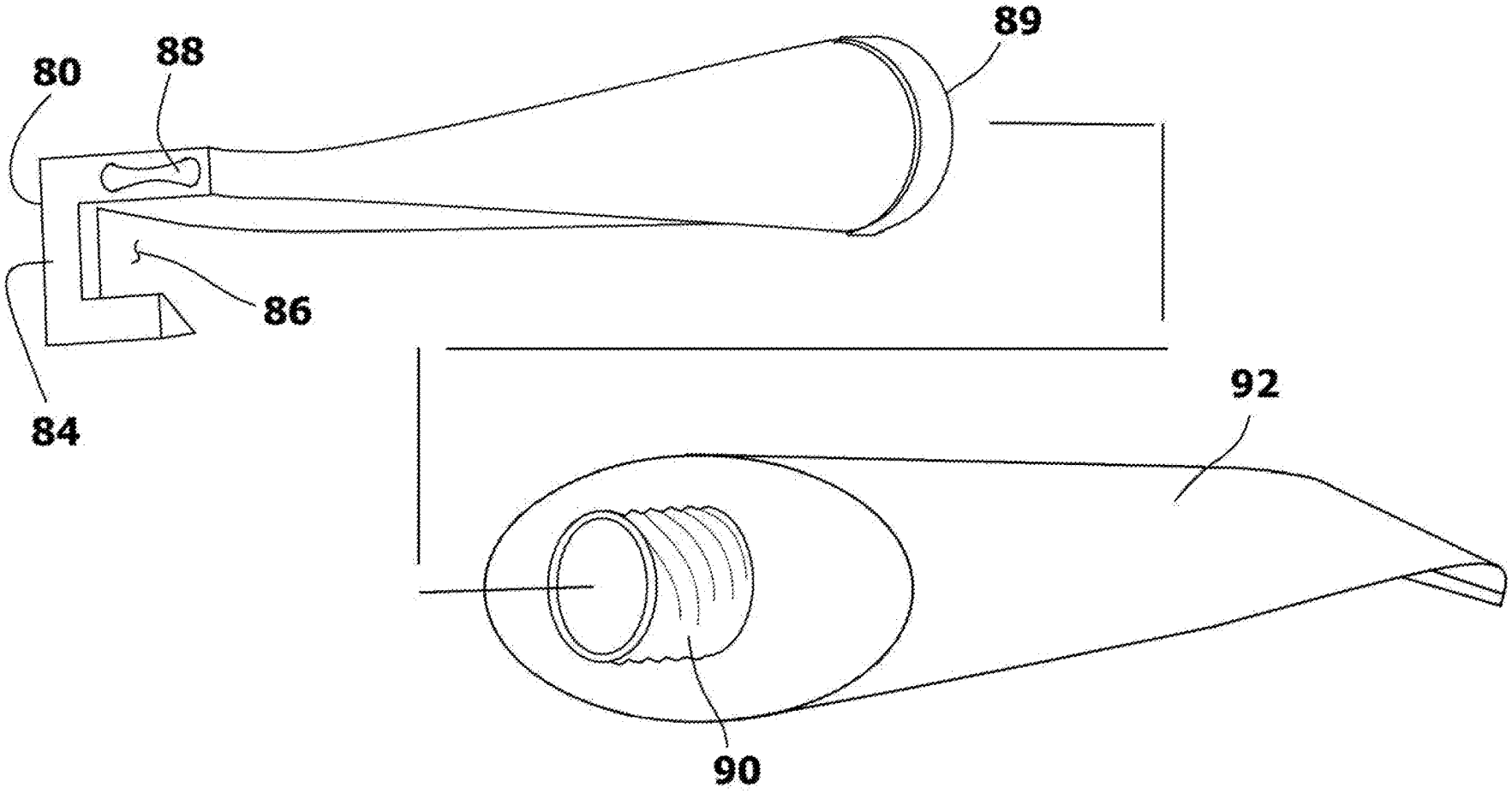
FIG. 6 shows an alternate embodiment of the auxiliary dispensing head.

In the earlier figures, the guide 50 on the auxiliary dispensing head 26 is configured to apply a ribbon 68 of material 14 onto the inside surface 70 of a driver's side vehicle door 60. Referring to FIG. 6, an alternate embodiment of a dispensing head 82 is shown. In this version of the dispensing head 82, it can be seen that a mirrored version of the guide 80 can be positioned on the opposite side of the auxiliary dispensing head 82 for use on passenger side vehicle doors. It will also be understood that the position of where the material is dispensed can be varied by altering the offset of the descending element 84 and the size of the gap space 86. Furthermore, the shape of the material being dispensed can be varied to any extruded shape by altering the shape of the second opening 88.

Additionally, in the shown embodiment of the dispensing head 82, the dispensing head has a first end 89 that is internally threaded. This enables the dispensing head to engage the threaded neck 90 of a disposable tube 94. This enables use of the invention when smaller volumes of material are to be dispensed.

The embodiments of the present invention that are illustrated and described are merely exemplary and that a person skilled in the art can make many variations to those embodiments. All such embodiments are intended to be included within the scope of the present invention as defined by the claims.

What is claimed is:

1. A dispensing head for a supply tube, comprising:

a first end having a first opening formed therein;

a second end having a bottom edge and a second opening formed therein;

a conduit that extends between said first opening and said second opening; and a guide extending from said second end, wherein said guide includes a descending element and a lateral foot element, wherein both said descending element and said lateral foot element have surfaces that are coplanar with said second end of said supply tube, and wherein said bottom edge of said second end, said descending element, and said lateral foot element define three sides of an open gap space.

2. The dispensing head according to claim 1, wherein said descending element extends from said second end at a perpendicular to said bottom edge.

3. The dispensing head according to claim 2, wherein said lateral foot element extends from said descending element in an orientation parallel to said bottom edge of said second end.

4. The dispensing head according to claim 3, wherein said guide is hook shaped and said lateral foot element has a flat inclined surface that faces said gap space.

5. The dispensing head according to claim 1, wherein said first opening at said first end is circular and said second opening at said second end is oblong.

6. The dispensing head according to claim 5, wherein said second opening has a long axis and said long axis is parallel to said bottom edge of said second end.

7. The dispensing head according to claim 1, wherein said descending element and said lateral foot element provide said guide with an L-shaped configuration.

8. The dispensing head according to claim 1, having an exterior surface and a flange formed on said exterior surface proximate said first end.

9. An auxiliary dispensing head for receiving a dispensing nozzle of a supply tube, said auxiliary dispensing head comprising:

a conduit sized to receive said dispensing nozzle, wherein said conduit terminates with a discharge opening at a distal end;

a guide that extends from said distal end, wherein said guide has a descending element and a lateral element having surfaces coplanar with said distal end.

10. The auxiliary dispensing head according to claim 9, wherein said distal end, said descending element, and said lateral element are hook shaped and define three sides of an open gap space.

11. The auxiliary dispensing head according to claim 10, wherein said distal end has a bottom edge and said descending element extends from said distal end at a perpendicular to said bottom edge.

12. The auxiliary dispensing head according to claim 11, wherein said lateral element extends from said descending element in an orientation parallel to said bottom edge of said distal end.

13. The auxiliary dispensing head according to claim 12, wherein said lateral element has a flat inclined surface that faces said gap space.

14. The auxiliary dispensing head according to claim 12, wherein said discharge opening is oblong.

15. The auxiliary dispensing head according to claim 14, wherein said discharge opening has a long axis and said long axis is parallel to said bottom edge of said distal end.

* * * * *